US005702262A

United States Patent [19]

Brown et al.

[11] Patent Number: 5,702,262

[45] Date of Patent: Dec. 30, 1997

[54] CONNECTOR ASSEMBLY

[75] Inventors: Gregory S. Brown, Ventura; Frank Quach, Northridge; Jose Silva, Reseda, all of Calif.

[73] Assignee: Trompeter Electronics, Inc., Westlake Village, Calif.

[21] Appl. No.: 725,849

[22] Filed: Oct. 4, 1996

[51] Int. Cl.[6] ..... H01R 29/00

[52] U.S. Cl. ..... 439/188; 439/944

[58] Field of Search ..... 439/188, 944

[56] References Cited

U.S. PATENT DOCUMENTS 5,280,254 1/1994 Hunter et al. ..... 439/188
5,382,173 1/1995 Brown et al. ..... 439/188

*Primary Examiner*—Neil Abrams
*Assistant Examiner*—T. C. Patel
*Attorney, Agent, or Firm*—Ellsworth R. Roston; Thomas A. Runk

[57] ABSTRACT

An insulating member has two (2) spring arms each normally biased to a first position and each pivotable to a second position. A pin in a housing at one end of the spring arms provides the spring arm pivot fulcrum. Resilient electrical conductors extend through apertures in the other ends of the spring arms. Looped portions in the conductors at positions beyond the apertures resiliently engage, respectively, probes and shield casings in a pair of electrical connectors when the spring arms are biased to the first positions. Additional looped portions in the conductors at positions between the apertures may be fixedly positioned relative to the housing by an insulating pin extending into the housing to the approximate center of such additional looped portions. The probes and shield casings are included in coaxial connectors disposed within the housing. The connectors include insulators between the probes and the shield casings. The connectors are coaxial with a pair of barrels disposed within the housing. A plug having a central pin, a shield and a coaxial casing is insertable into individual ones of the barrels to displace the electrical conductors from the probe coaxial with the plug and to establish an electrical circuit between (a) the pin and the probe (b) the shield casing in such connector and the plug shield and (c) the coaxial casing in the plug and the individual one of the barrels. When the plug is not inserted into either barrel, an electrical circuit includes the probes and the shield casings in the electrical conductors.

35 Claims, 4 Drawing Sheets

CONNECTOR ASSEMBLY

This invention relates to electrical connectors. More particularly, the invention relates to an assembly in which two (2) electrical connectors are disposed in a common housing and in which (a) the two (2) connectors are in series in a first operative relationship, (b) a circuit is established through only one of the connectors in a second relationship and (c) a circuit is established through only the other connector in a third relationship. The invention particularly relates to an arrangement in which the connectors are miniaturized.

BACKGROUND OF THE INVENTION

Electrical connectors have been in existence for decades. They are used to provide a continuity bridge between different circuits. When the connectors are triaxial, they generally include a centrally disposed probe and a shield casing in concentric, enveloping and insulating relationship to the probe and to a housing body. Signals are generally introduced to the probe and the casing. The housing body is provided for shielding the probe from electrical noise and for providing a ground reference potential.

Since electrical connectors constitute basic components in electrical systems and electrical equipments, many different types of connectors have been provided through the years. For example, a connector assembly has been provided with a pair of connectors disposed in a housing. Each of the connectors has included a probe, a shield casing enveloping the probe in insulating relationship to the probe and a barrel enveloping the shield casing in insulating relationship to the shield casing. An actuator has been movable to a first position connecting the probes or to a second position disconnecting the probes.

It has been desired for some time to extend the scope of operation of a connector assembly constructed as described in the previous paragraph. For example, it has been desired to provide a connector assembly with two (2) connectors such as described in the previous paragraph where an electrical continuity is established between the two (2) connectors in a relationship of non-actuation and where an electrical continuity is established through one of the connectors in a position of actuation. Until recently, no one has been able to provide such a connector.

U.S. Pat. No. 5,280,254 issued to Tracy A. Hunter and Jose Silva on Jan. 18, 1994, for a "Connector Assembly" and assigned of record to the assignee of record of this application discloses and claims a connector assembly which meets the parameters specified in the previous paragraph. In U.S. Pat. No. 5,280,254, a connector assembly includes first and second conductive probes, first and second conductive shield casings respectively enveloping the first and second probes in an insulated relationship with the probes and a housing insulating and enveloping the casings. First and second barrels may be disposed within the housing at the opposite end of the housing in enveloping relationship to one of the shield casings.

An assembly including an impedance is insulatingly supported by the third and fourth barrels in the connector assembly of U.S. Pat. No. 5,280,254. An actuator assembly insulatingly supported by the first and second barrels has (a) a first operative relationship establishing electrical continuity between the probes and between the shield casings and (b) a second operative relationship interrupting such continuities and establishing a circuit including an individual one of the probes, the impedance and the corresponding one of the shield casings.

The actuator assembly in U.S. Pat. No. 5,280,254 includes first and second actuators having a fixed and insulating relationship to each other. Each actuator is fixedly attached to the barrels at an intermediate position to define first and second resilient arms. The arms on each individual one of the actuators are constructed to engage the opposite ends of the impedance when the arms are actuated. This occurs when a plug is inserted into the particular one of the first and second barrels associated with such arms. Insulators on the arms insulate the arms from the plugs.

U.S. Pat. No. 5,382,173 to Gregory S. Brown, Frank Quach and Jose Silva on Jan. 17, 1995, for an "Electrical Connector" and assigned of record to the assignee of record of this application discloses a connector assembly with a number of the features of U.S. Pat. No. 5,280,254. However, the connector assembly of U.S. Pat. No. 5,382,173 is especially adapted to provide electrical connections to systems which operate at high frequencies such as in the range of hundreds of megahertz. The connector of U.S. Pat. No. 5,280,254 accomplishes this in part by minimizing the lengths of the actuators or spring arms, by insulating the free ends of the spring arms and by attaching a conductive wire between the free ends of the actuators or spring arms.

As time has progressed, integrated circuits have decreased in size. This has resulted in part from the decrease in the thickness of the electrical lines in such integrated circuits. For example, just in approximately the last ten (10) years, the thickness in the electrical leads in integrated circuits has decreased from approximately two (2) or three (3) microns (3 μ) to less than one half micron (½ μ). The space for disposing electrical connectors to introduce signals to the electrical circuits for processing or to pass signals from the electrical circuits has accordingly decreased significantly in that period of time. In spite of this, similar decreases in the sizes of electrical connectors have not occurred.

BRIEF DESCRIPTION OF INVENTION

This application provides a connector assembly which has a miniature size compared to connector assemblies of the prior art including the connector assemblies of U.S. Pat. Nos. 5,280,254 and 5,383,173. In spite of its miniature size, the connector assembly disclosed and claimed in this application operates efficiently in providing for the passage of a signal through either one of two (2) connectors in the assembly or through a circuit including both of the connectors in the assembly.

In one embodiment of the invention, an insulating member has two (2) spring arms each normally biased to a first position and each pivotable to a second position. A pin in a housing at one end of the spring arms provides the spring arm pivot fulcrum. Resilient electrical conductors extend through apertures in the other ends of the spring arms.

Looped portions in the conductor at positions beyond the apertures resiliently engage, respectively, probes in a pair of electrical connectors when the spring arms are biased to the first positions. Additional looped portions in the conductors at positions between the apertures may be fixedly positioned relative to the housing by an insulating pin extending into the housing to the approximate center of such additional looped portions.

The probes and shield casings are included in coaxial connectors disposed within the housing. The connectors include insulators between the probes and the shield casings. The connectors are coaxial with a pair of barrels disposed within the housing. A plug having a central pin, a shield and a coaxial casing is insertable into individual ones of the barrels to displace the electrical conductors from the probe coaxial with the plug and to establish an electrical circuit between (a) the pin and the probe (b) the shield casing in such connector and the plug shield and (c) the coaxial casing in the plug and the individual and one of the barrels. When the plug is not inserted into either barrel, an electrical circuit includes the probes and the shield casings in the electrical conductors.

DETAILED DESCRIPTION OF THE INVENTION

Figure 1:
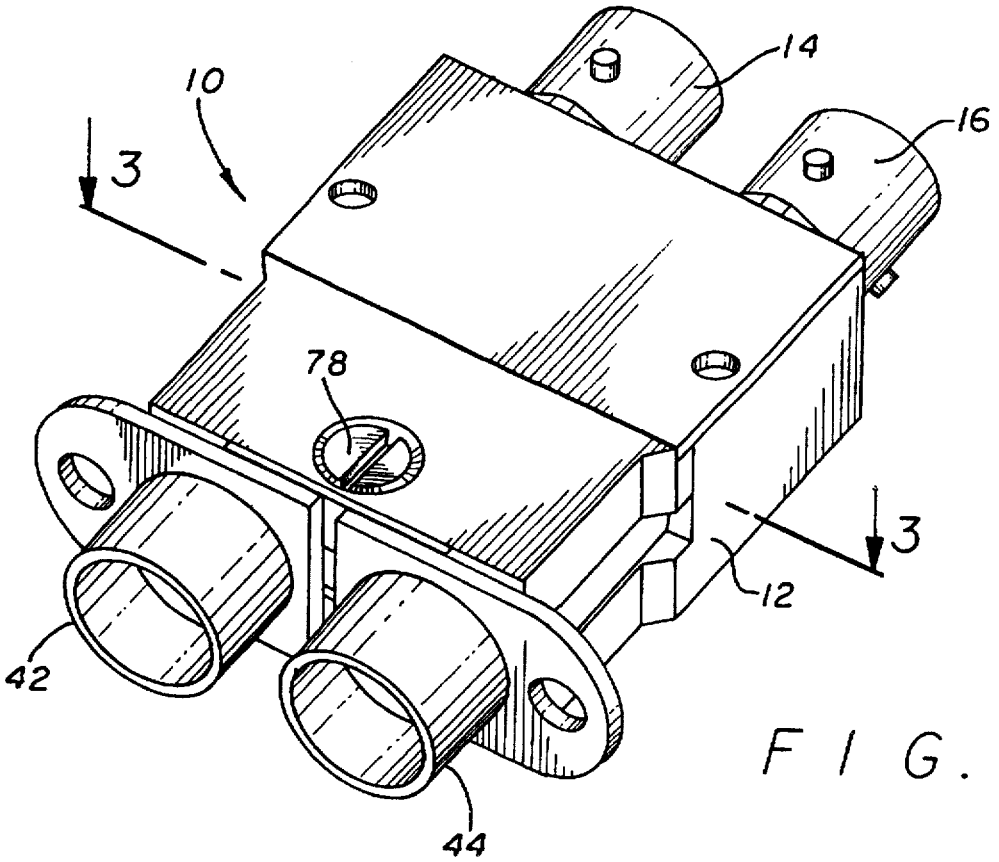
FIG. 1 is a perspective view of a connector assembly constituting one embodiment of the invention.
Figure 2:
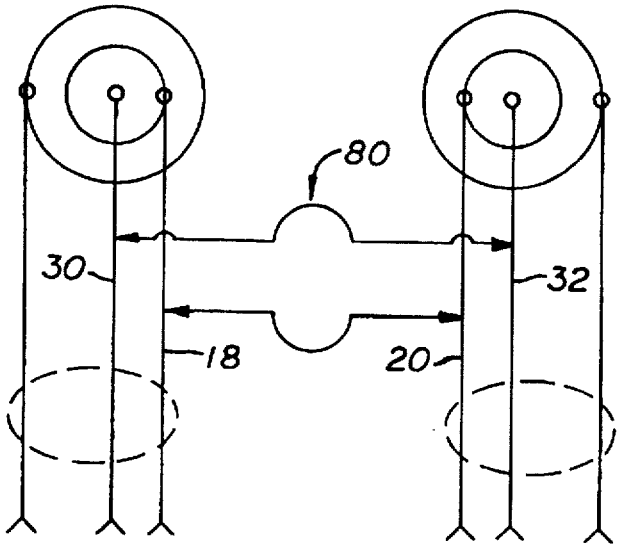
FIG. 2 is a schematic diagram showing the electrical continuities established in the electrical connector assembly shown in FIG. 1 when the connector assembly is operated in different relationships.

In one embodiment of the invention, a connector assembly generally indicated at 10 is provided. The connector assembly 10 includes a hollow housing 12 (FIG. 1), made from a suitably conductive material. The housing 12 is shaped at one axial end to define a pair of barrels 14 and 16, preferably annular, made from an electrically conductive material and suitably separated from each other.

Shield casings 18 and 20 (FIGS. 3, 4 and 5) made from a suitably conductive material are respectively disposed in the barrels 14 and 16 in concentric relationship with the barrels. The shield casings 18 and 20 may be respectively insulated electrically from the barrels 14 and 16 as by insulators 22 and 24. Openings 26 and 28 may be respectively provided in the shield casings 18 and 20 and the insulators 22 and 24 near the axially inner ends of the shield casings.

Electrically conductive probes 30 and 32 are disposed within the shield casings 18 and 20 in concentric relationship with the shield casings. The probes 30 and 32 are respectively insulated from the shield casings 18 and 20 as by insulators 34 and 36. The insulators 34 and 36 are open as at 38 and 40 at positions adjacent the openings 26 and 28 in the casings 18 and 20. In this way, the probes 32 and 34 are exposed at the positions of the openings 26 and 28.

Barrels 42 and 44 preferably made from an electrically conductive material are disposed at the opposite axial end of the housing 12 from the barrels 14 and 16. The probe 30 and the shield casing 18 extend into the barrel 42. Similarly, the probe 32 and the shield casing 20 extend into the barrel 44. An insulator 46 is disposed within the barrel 42 between the probe 30 and the shield casing 18. Similarly, an insulator 48 is disposed within the barrel 44 between the probe 32 and the shield casing 20. A shield contact spring 50 is disposed within the barrel 42 in spaced relationship to the casing 18. Similarly, a shield contact spring 52 is disposed within the barrel 44 in spaced relationship to the casing 20.

Figure 4:
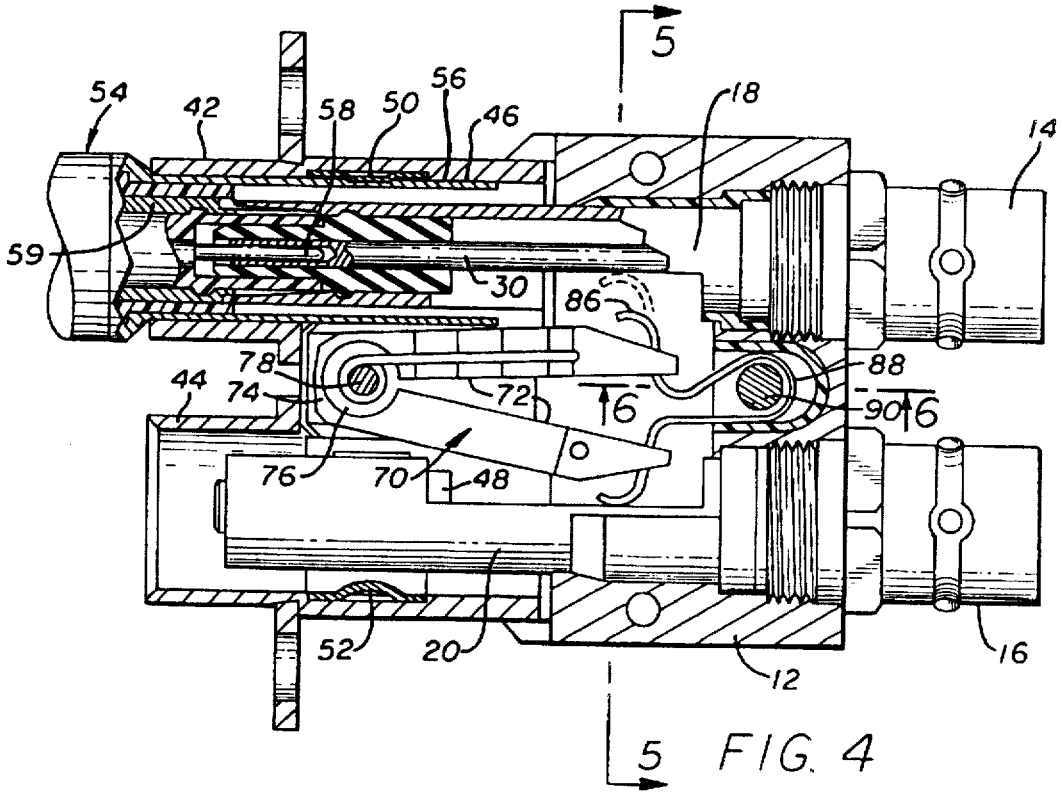
FIG. 4 is a view, partially in section, similar to that shown in FIG. 3 and shows the disposition of a spring arm in the connector assembly when a plug is inserted into a barrel in the connector assembly.
Figure 5:
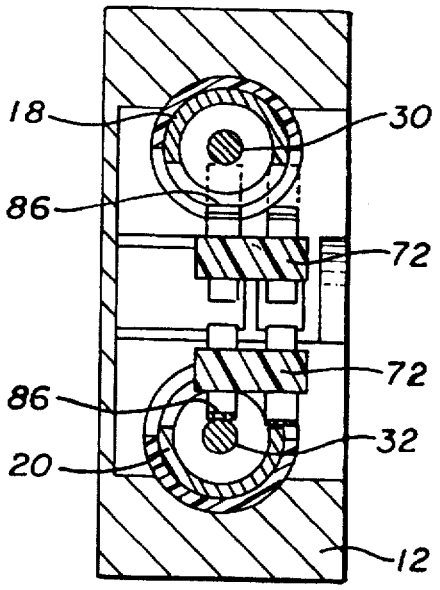
FIG. 5 is a sectional view of the connector assembly and is taken substantially on the line 5—5 of FIG. 4.
Figure 6:
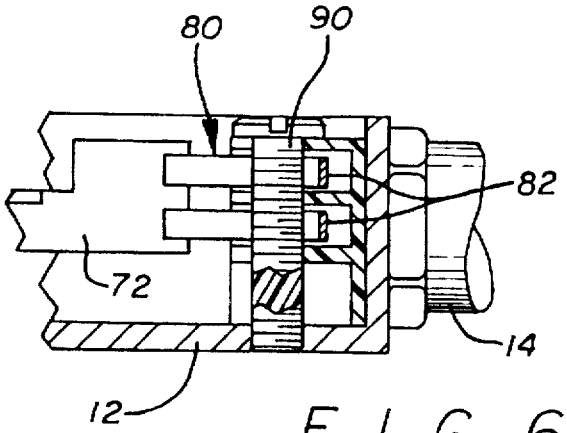
FIG. 6 is another sectional view of the connector assembly and is taken substantially on the line 6—6 of FIG. 4.
Figure 7:
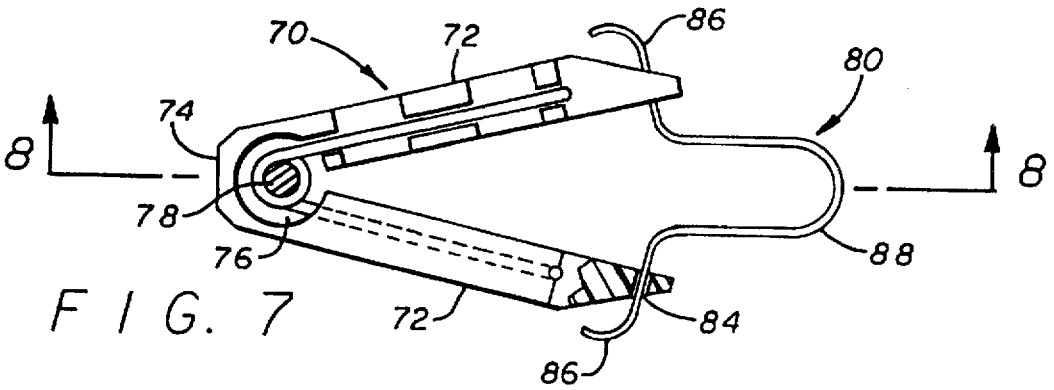
FIG. 7 is an enlarged plan view of a spring arm sub-assembly in the connector assembly.
Figure 8:
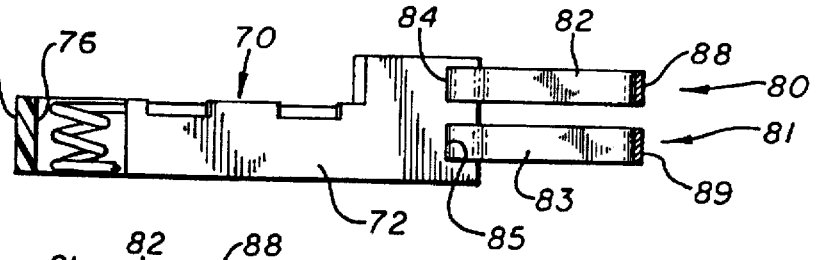
FIG. 8 is a sectional view of the spring arm sub-assembly and is taken substantially on the line 8—8 of FIG. 7.
Figure 9:
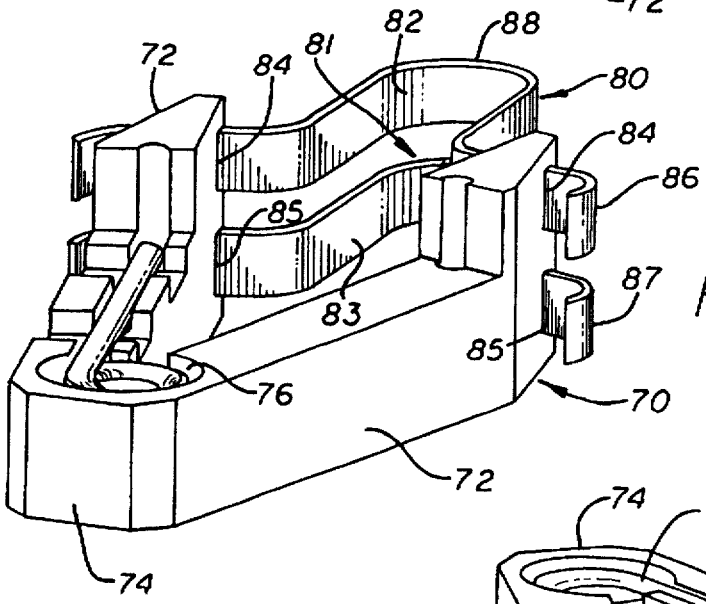
FIG. 9 is an enlarged perspective view of the spring arm sub-assembly shown in FIGS. 7 and 8 as seen from a position above and to the left of the spring arm sub-assembly.
Figure 10:
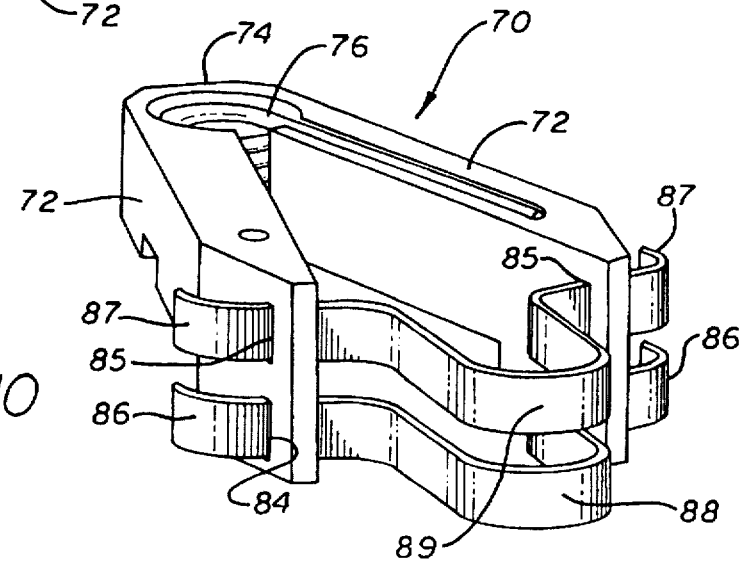
FIG. 10 is an enlarged perspective view of the spring arm sub-assembly shown in FIGS. 7 and 9 as seen from a position above and to the right of the spring arm sub-assembly.

The barrels 42 and 44 are constructed to removably receive a plug generally indicated at 54 in FIG. 4. The plug 54 includes a coaxial casing 56, preferably annular, made from an electrically conductive material. The coaxial casing 56 is provided with a diameter to fit snugly in each individual one of the barrels 42 and 44 and to be retained in fixed position in such barrel by the respective one of the shield contact springs 50 and 52. The plug 54 includes a central pin 58 which fits on individual ones of the probes 30 and 32 in abutting relationship with such individual ones of the probes. The plug 54 also includes a coaxial shield 59 (preferably a spring finger type) which fits within individual ones of the shield casings 18 and 20 in coaxial and abutting relationship with the central pin 58 and the coaxial casing 56.

An actuator assembly generally indicated at 70 (FIGS. 3, 4 and 7–10) is fixedly supported by the housing 12. The actuator assembly 70 includes a pair of spring arms 72 made from an electrically insulating and resilient material such as nylon. The spring arms 72 are integral with a base portion 74 (FIGS. 7–10) which co-operates with the spring arms in defining a socket 76 for receiving a pin 78 threaded into the housing 12. The pin 78 defines a fulcrum for pivoting each of the spring arms 72 independently of the other.

Two electrical conductors generally indicated at 80 and 81 (FIGS. 8–10) are coupled to the spring arms 72. The conductors 80 and 81 may be made from a resilient metal such as a beryllium copper having a high electrical conductivity and may be formed from a pair of straps 82 and 83 disposed in spaced and parallel relationship to each other. The straps 82 and 83 may extend through apertures 84 and 85 near the free ends of the spring arms 72.

The strap 82 may then be looped as at 86 at positions beyond the aperture 84 to resiliently engage the probes 30 and 32 at the positions on the probes. In like manner, the strap 83 may be looped as at 87 at positions beyond the aperture 85 to resiliently engage the shield casings 18 and 20 where the shield casings 18 and 20 and the insulators 22 and 24 have been removed. The straps 82 and 83 respectively also have a looped configuration as at 88 and 89 at an intermediate position between the spring arms 72. The straps 82 are retained in fixed position at the looped configurations 88 and 89 by an insulating pin 90 (FIGS. 3 and 4) which extends into the housing 12.

Figure 3:
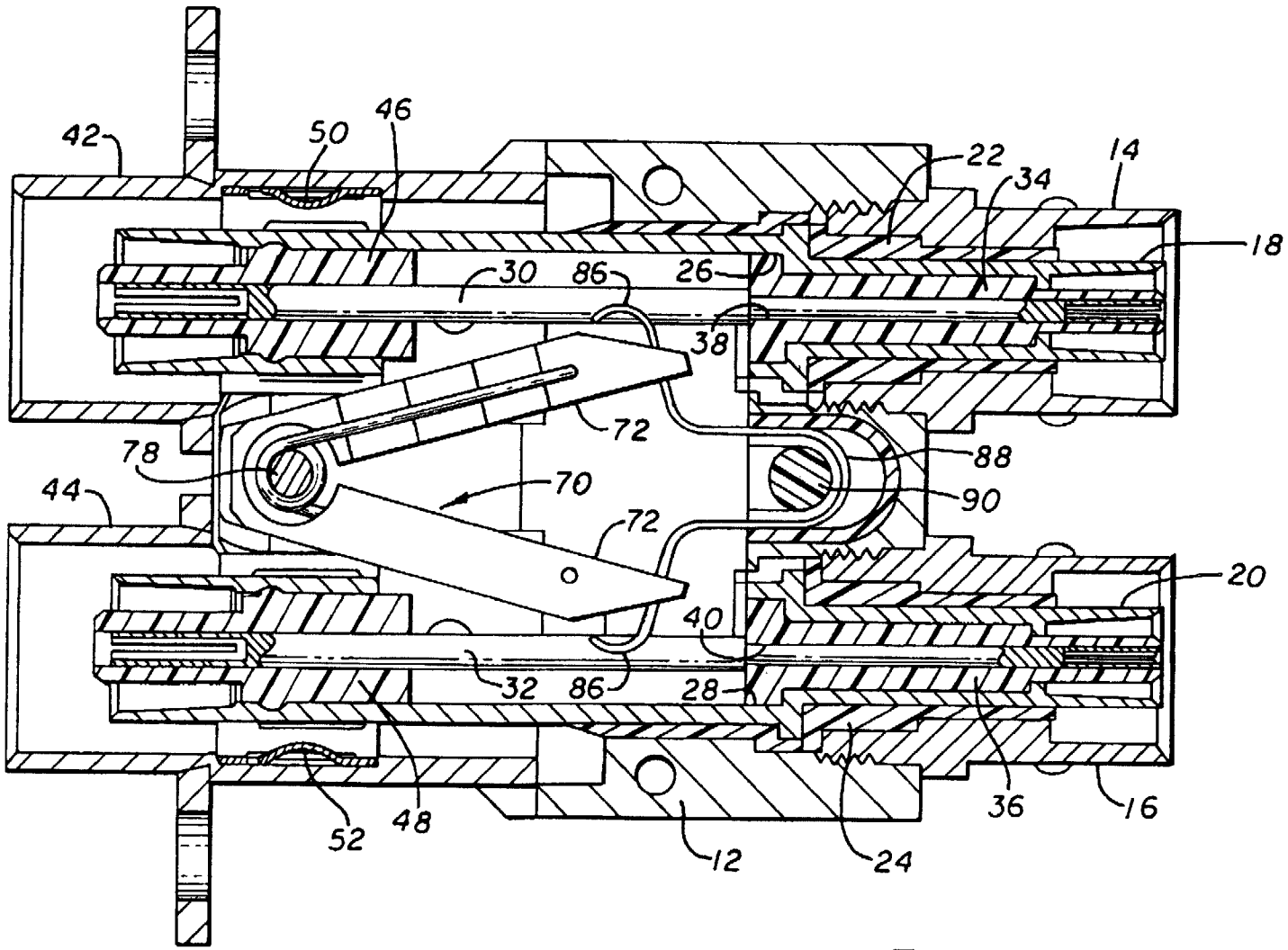
FIG. 3 is a sectional view of the connector assembly and is taken substantially on the line 3—3 of FIG. 1.

As will be best seen in FIG. 3, the opposite looped portions 86 of the strap 82 are biased respectively to engage the probes 30 and 32 so as to establish an electrical path including the probes and the electrical conductor 80. Similarly, the opposite looped portions 87 of the strap 83 are biased to establish an electrical path including the shield casings 18 and 20 and the electrical conductor 81.

When the plug 54 is inserted into an individual one of the barrels 42 and 44, it engages an individual one of the spring arms 72 associated with such individual one of the barrels.

As best seen in FIG. 4, this causes the looped portion 86 of the electrical conductor 80 adjacent the probe 30 and the looped portion 87 of the electrical conductor 81 adjacent the shield casing 18 to become respectively displaced from electrical continuity with the probe 30 and the shield casing 18. This causes the probes 30 and 32 to be electrically isolated from each other and the shield casings 18 and 20 to be electrically isolated from each other. As a result, an electrical path is established through the connector associated with the displaced one of the looped portions 86 and 87 independently of the operation of the other one of the connectors. For example, when the plug 54 is inserted into the barrel 42 as shown in FIG. 4, the pin 58 establishes electrical continuity with the probe 30, the shield 59 establishes electrical continuity with the shield casing 18 and the coaxial casing 56 establishes electrical continuity with the barrel 42.

The connector assembly 10 has certain important advantages. It provides two (2) connectors in a relationship in which the two (2) connectors can be connected in series in a single circuit or in which each connector can be connected in a circuit independently of the other. The connector assembly 10 is additionally advantageous in that it is formed in a minitiarized relationship.

Although this invention has been disclosed and illustrated with reference to particular embodiments, the principles involved are susceptible for use in numerous other embodiments which will be apparent to persons of ordinary skill in the art. The invention is, therefore, to be limited only as indicated by the scope of the appended claims.

We claim:

1. In combination, a first connector having a first electrically conductive probe and a first shield casing, the first probe being disposed in a coaxial and insulated relationship with the first shield casing, a second connector having a second electrically conductive probe and a second shield casing, the second probe being disposed in a coaxial and insulated relationship with the second shield casing, the first and second shield casings being disposed in a spaced and insulated relationship to each other, first means having first and second spring arms made from an electrically insulating material and biased toward an engaged relationship with associated ones of the first and second probes, first resilient means made from an electrically conductive material and extending between the ends of the first and second spring arms in one operative relationship to establish electrical contacts with the first and second probes in the one operative relationship, second resilient means made from an electrically conductive material and extending between the ends of the first and second spring arms to establish electrical continuity with the first and second shield casings in the one operative relationship, and the individual ones of the first and second spring arms being respectively movable into a displaced relationship of the first resilient means relative to the associated ones of the first and second probes and into a displaced relationship of the second resilient means relative to the associated ones of the first and second shield casings to disestablish electrical continuity between the resilient member and the associated ones of the probes and the shield casings.

2. In the combination as set forth in claim 1, the first resilient means having first and second portions respectively extending through the associated ones of the first and second spring arms to establish electrical continuities of the first resilient means with the first and second probes, and the second resilient means respectively extending through the associated ones of the first and second spring arms to establish electrical continuity of the second resilient means with the first and second shield casings.

3. In the combination as set forth in claim 1, the first and second spring arms respectively terminating at positions short of the first and second probes, and the opposite ends of the first resilient means respectively extending from the ends of the first and second spring arms into engagement with the first and second probes in the unconstrained positions of the spring arms and the opposite ends of the second resilient means respectively extending from the ends of the first and second spring arms into engagement with the first and second shield casings in the unconstrained positions of the spring arms.

4. In the combination as set forth in claim 3, a first insulator on the first probe between the first shield casing and the first probe, a second insulator on the second probe between the second shield casing and the second probe, the first insulator and the first shield casing being removed from the first probe at a position relative to the first spring arm to provide for an engagement between the first probe and the first resilient means in the unconstrained position of one of the spring arms, the second insulator and the second shield casing being removed from the second probe at a position relative to the second spring arm to provide for an engagement between the second probe and the second resilient means in the unconstrained position of the other one of the spring arms.

5. In the combination as set forth in claim 4, the first resilient means having first and second portions respectively extending through the associated ones of the first and second spring arms to establish electrical continuity of the first resilient means with the first and second probes at the positions where the first insulator and the first casing, and where the second insulator and the second casing, are respectively removed from the first and second probes and the second resilient means having first and second portions respectively extending through the associated ones of the first and second spring arms to establish electrical continuity of the second resilient means with the first and second shield casings.

6. In combination, a connector having a shield casing, an insulator disposed within the shield casing in coaxial relationship with the shield casing and an electrically conductive probe disposed within the insulator in coaxial relationship with the shield casing and the insulator, a spring arm made from an electrically insulating material and pivotable at a first end and having a second end and pivotally biased at the first end to a first relationship, a resilient member made from an electrically conductive material and extending through the spring arm near the second end of the spring arm into engagement of the resilient member with the electrically conductive probe in the first relationship of the spring arm, and first means for pivoting the second end of the spring arm to a second relationship where the resilient member does not engage the probe, the second relationship of the spring arm being different from the first relationship of the spring arm.

7. In the combination as set forth in claim 6, a barrel portion disposed in a coaxial relationship with the shield casing and constructed to receive the first means for displacing the spring arm from the first relationship of the spring arm to the second relationship of the spring arm when the first means is received by the barrel portion.

8. In the combination as set forth in claim 6 wherein the resilient member has a looped portion which extends through the spring arm for movement with the spring arm and which engages the probe in the first relationship of the spring arm and which becomes displaced from the probe in the second relationship of the spring arm.

9. In the combination as set forth in claim 6, the resilient member being a first resilient member, and a second resilient member made from an electrically conductive material and extending through the spring arm near the second end of the spring arm into an engagement of the second resilient member with the shield casing in the first relationship of the spring arm, the first means being operative to provide for a pivotal movement of the second end of the spring arm to the second relationship of the spring arm where the second resilient member does not engage the shield casing.

10. In the combination as set forth in claim 9 wherein the first resilient member has a first portion which engages the probe in the first relationship of the spring arm and wherein the second resilient member has a first portion which engages the shield casing in the first relationship of the spring arm and wherein the first resilient member has a second portion displaced from the first portion and from the spring arm and fixedly disposed relative to the connector and wherein the second resilient member has a second portion displaced from the first portion and from the spring arm and fixedly disposed relative to the connector.

11. In the combination as set forth in claim 6, the insulator and the shield casing being removed from the probe at the position where the resilient member engages the probe in the first relationship of the spring arm to provide for an engagement of the probe by the resilient member in the first relationship of the spring arm.

12. In the combination as set forth in claim 11, a barrel portion disposed in coaxial relationship with the shield casing and constructed to receive the first means for displacing the spring arm from the first relationship of the spring arm to the second relationship of the spring arm when the first means is received by the barrel portion, the resilient member having at one end a looped relationship which extends through the spring arm for movement of the resilient member with the spring arm and which engages the probe in the first relationship of the spring arm, and second means disposed relative to the resilient member at a position displaced from the one end for fixedly disposing the resilient member relative to the connector.

13. In the combination as set forth in claim 12, the shield casing being made from an electrically conductive material, and the second means being made from an electrically insulating material.

14. In the combination as set forth in claim 12, the first means constituting a plug disposable within the barrel portion to move the spring arm from the first relationship of the spring arm to the second relationship of the spring arm.

15. In combination, first and second connectors each having a probe, an insulator enveloping the probe and a shield casing enveloping the insulator, first and second spring arms made from an electrically insulating material, a first electrical conductor disposed on the spring arms, the spring arms being normally biased for engagement of the first electrical conductor with the probes in the first and second connectors, a second electrical conductor disposed on the spring arms, the spring arms being normally biased for engagement of the second electrical conductor with the shield casings in the first and second connectors, the first and second electrical conductors being made from an electrically conductive and resilient material and having opposite ends and the first electrical conductor being respectively anchored at its opposite ends by the first and second spring arms and having first portions extending beyond the portions anchored in the first and second spring arms and resiliently engaging the first and second probes, and the second electrical conductor being anchored at its opposite ends by the first and second spring arms and having first portions extending beyond the portions anchored in the first and second spring arms and resiliently engaging the first and second shield casings.

16. In the combination as set forth in claim 15, means for anchoring the first electrical conductor relative to the first and second connectors at a position between the spring arms and in an electrically insulating relationship to the first and second connectors and for anchoring the second electrical conductor relative to the first and second connectors at a position between the spring arms and in an electrically insulating relationship to the first and second connectors.

17. In the combination as set forth in claim 15, the first electrical conductor being made from a first strap and the second electrical conductor being made from a second strap spaced from the first strap, the first strap extending between the probes in a looped configuration and the second strap extending between the shield casings in a looped configuration, and means for anchoring the looped configurations of the electrical conductors in an insulating relationship to the shield casings in the first and second connectors.

18. In the combination as set forth in claim 17, first and second barrel members respectively disposed in spaced and coaxial relationship with the first and second connectors and constructed to receive a plug for displacing respective ones of the first and second spring arms from respective ones of the first and second probes and from respective ones of the first and second shield casings to displace the first electrical conductor from respective ones of the first and second probes and to displace the second electrical conductor from respective ones of the first and second shield casings.

19. In the combination as set forth in claim 18, each of the spring arms having first and second apertures, each of the first and second electrical conductors having first and second ends and the first ends of the first and second electrical conductors respectively extending through the apertures in the first spring arm and, after extending through the apertures in the first spring arm, defining first loops for respectively engaging the first probe and the first shield casing and the second ends of the first and second electrical conductors respectively extending through the apertures in the second spring arm and, after extending through the apertures in the second spring arm, defining second loops for respectively engaging the second probe and the second shield casing.

20. In the combination as set forth in claim 16, first and second barrel members respectively disposed in spaced and coaxial relationship with the first and second connectors and constructed to receive a plug for displacing respective ones of the first and second spring arms from the first and second probes and from the first and second shield casings to displace the first electrical conductor respectively from the first and second probes and the second electrical conductor respectively from the first and second shield casings.

21. In the combination as set forth in claim 20, the shield casing and the insulator in the first connector being removed at a position between the first connector and the first barrel member to expose the probe in the first connector for resilient engagement of such probe by the first end of the first electrical conductor and the shield casing and the insulator in the second connector being removed at a position between the second connector and the second barrel member to expose the probe in the second connector for resilient engagement of such probe by the second end of the first electrical conductor.

22. In combination, a housing having first and second barrels at one end of the housing and having third and fourth barrels at an opposite end of the housing, first and second connectors respectively disposed in the first and second barrels, each of the connectors having a probe, an insulator enveloping the probe in a co-axial relationship with the probe and a shield casing enveloping the insulator in a co-axial relationship with the insulator, a pair of spring arms made from an electrically insulating material, each of the spring arms having first and second ends and each supported at the first end by the housing at a position between the third and fourth barrels for pivotable movement on a fulcrum at the first end of such spring arm, a pair of electrical conductors each made from a resilient material and coupled to the spring arms at positions near the second ends of the spring arms, a first one of the electrical conductors being disposed to resiliently engage the probes at positions on such electrical conductor beyond the couplings of such electrical conductor to the spring arms, the other one of the electrical conductors being disposed to resiliently engage the shield casings at positions on such electrical conductor beyond the couplings of such electrical conductor to the spring arms, the housing providing a common electrical potential between the first, second, third and fourth barrels.

23. In the combination as set forth in claim 22, the first one of the electrical conductors having looped portions extending beyond the couplings to the spring arms for engaging the probes and the other one of the electrical conductors having looped portions extending beyond the couplings to the spring arms for engaging the shield casings.

24. In the combination as set forth in claim 22, each of the electrical conductors having a looped portion intermediate the positions of coupling of such electrical conductor to the spring arms, and means supported by the housing for retaining the electrical conductors in a fixed relationship to the housing at the looped portions of the electrical conductors.

25. In the combination as set forth in claim 22, the spring arms having a base portion at the first ends and being integral at the base portion, and means extending through the housing and the base portion in an electrically insulating relationship to the housing for retaining the base portion in a fixed relationship to the housing and for providing a fulcrum for the pivotal movement of the spring arms.

26. In the combination as set forth in claim 22, a plug for extending into an individual one of the third and fourth barrels for pivoting the spring arm associated with such individual one of the third and fourth barrels on the fulcrum at the first end of such spring arm to move the portions of the electrical conductors associated with such spring arm from engagement with the probe concentric with such individual one of the third and fourth barrels and from engagement with the shield casing concentric with such individual one of the third and fourth barrels.

27. In the combination as set forth in claim 25, the first electrical conductor having looped portions extending beyond the couplings to the spring arms for respectively engaging the probes and the second electrical conductor having looped portions extending beyond the couplings to the spring arms for respectively engaging the shield casings, each of the electrical conductors having an additional looped portion intermediate the positions of the couplings of the electrical conductors to the spring arms, and retaining means supported by the housing in an electrically insulating relationship to the housing for retaining the electrical conductors in a fixed relationship to the housing at the position of the additional looped portions in the electrical conductors.

28. In the combination as set forth in claim 27, the shield casings and the insulators in the connectors being removed from the probes in such connectors at the positions where the looped portions of the electrical conductors respectively engage the probes and the shield casings, and the retaining means being made from an electrically insulating material.

29. In combination, a housing having first and second ends and having first and second barrels spaced from each other at the first end of the housing and having third and fourth barrels spaced from each other at the second end of the housing, a pair of electrical connectors each disposed in an individual one of the first and second barrels and including a probe, an insulator on the probe and a shield casing on the insulator, the housing defining a cavity between the first and second barrels and the third and fourth barrels, the first and third barrels being coaxial and the second and fourth barrels being coaxial, means including a pair of spring arms made from an insulating material and disposed in the housing for pivotal movement on a fulcrum between the third and fourth barrels and extending into the cavity, a first electrical conductor made from a resilient material and supported by the spring arms in the cavity for resilient engagement at its opposite ends with the probes in the first and second connectors, a second electrical conductor made from a resilient material and supported by the spring arms in the cavity for resilient engagement at its opposite ends with the shield casings in the first and second connectors, the spring arms being normally biased to a first position providing an engagement between the opposite ends of the first electrical conductor and the probes and between the opposite ends of the second electrical conductor and the shield casings and each of the spring arms being pivotable to a position disengaging the first electrical conductor from one of the probes and the second electrical conductor from one of the shield casings.

30. In the combination as set forth in claim 29, the spring arms having apertures near the ends of the spring arms opposite the fulcrum, and the electrical conductors extending through the apertures in the spring arms and being looped at positions beyond the apertures in the spring arms to provide an engagement between the first electrical conductor and the probes at the looped positions of the first electrical conductor and to provide an engagement between the second electrical conductor and the shield casings at the looped positions of the second electrical conductor.

31. In the combination as set forth in claim 29, the electrical conductors having looped configurations at positions intermediate the spring arms, and means extending into the housing for fixedly positioning the electrical conductors in an electrically insulated relationship to the housing at the intermediate positions of the electrical conductors.

32. In the combination as set forth in claim 29 for use with a plug, means extending into the housing for biasing the spring arms into the positions providing electrical conductivity between the first electrical conductor and the probes and between the second electrical conductor and the shield casings, each of the third and fourth barrels being constructed to receive the plug and to provide for a displacement of an individual one of the spring arms to move the first electrical conductor from engaging the individual one of the probes associated with the individual one of the spring arms and to move the second electrical conductor from engaging the individual one of the shield casings associated with the individual one of the spring arms.

33. In the combination as set forth in claim 32, the electrical conductors being fixedly positioned in an electrically insulated relationship to the housing at positions intermediate the spring arms, means extending into the housing for biasing the spring arms to the positions providing electrical conductivity between the first electrical conductor and the probes and between the second electrical conductor and the shield casings, each of the third and fourth barrels being constructed to receive the plug and to provide for a displacement of individual ones of the spring arms to move the first electrical conductor from engaging an individual one of the probes and to move the second electrical conductor from engaging an individual one of the shield casings.

34. In the combination as set forth in claim 29, the first electrical conductor being coupled to the spring arms at positions near the opposite ends of the spring arms and being resiliently engaged by the probes at positions beyond the positions of the coupling of such first electrical conductor to the spring arms, and the second electrical conductor being coupled to the spring arms at positions near the opposite ends of the spring arms and being resiliently engaged by the shield casings at positions beyond the positions of the couplings of such second electrical conductor to the spring arms, the shield casings and the insulators being partially removed from the probes at the positions where the first electrical conductor resiliently engages the probes.

35. In the combination as set forth in claim 34, means extending into the housing for biasing the spring arms to the positions providing electrical continuity between the first electrical conductor and the probes and between the second electrical conductor and the shield casings, each of the third and fourth barrels being constructed to receive the plug and to provide for a displacement of individual ones of the spring arms to move the first electrical conductor from engaging an individual one of the probes and to move the second electrical conductor from engaging an individual one of the shield casings, the electrical conductors having looped configurations at positions intermediate the spring arms, and means extending into the housing for fixedly positioning the electrical conductors at the intermediate positions of the electrical conductors in an insulated relationship to the housing.

* * * * *